US007643044B2

(12) United States Patent
Henry

(10) Patent No.: US 7,643,044 B2
(45) Date of Patent: Jan. 5, 2010

(54) THERMAL PRINTER DEVICE FOR POINT OF SERVICE TERMINAL

(75) Inventor: Chris Henry, Phoenix, AZ (US)

(73) Assignee: Hypercom Corporation, Scottsdale, AZ (US)

( * ) Notice: Subject to any disclaimer, the term of this patent is extended or adjusted under 35 U.S.C. 154(b) by 107 days.

(21) Appl. No.: 11/736,297

(22) Filed: Apr. 17, 2007

(65) Prior Publication Data

US 2008/0025779 A1 Jan. 31, 2008

Related U.S. Application Data

(60) Provisional application No. 60/792,788, filed on Apr. 17, 2006.

(51) Int. Cl.
*B41J 2/32* (2006.01)

(52) U.S. Cl. ..... 347/197

(58) Field of Classification Search ..... 347/197, 347/198, 211, 218, 221, 171, 190, 193; 400/82, 400/613.2, 613.4
See application file for complete search history.

(56) References Cited

U.S. PATENT DOCUMENTS

2007/0212146 A1* 9/2007 Lyons et al. ..... 400/82

* cited by examiner

*Primary Examiner*—K. Feggins
(74) *Attorney, Agent, or Firm*—Snell & Wilmer, LLP

(57) ABSTRACT

The present invention provides for a compact, portable POS terminal through the use of a compact printer that utilizes a thermal printer with fan-folded paper. The POS terminal also accommodates contactless instrument readers and optionally includes features for electronic signature capture, user display interaction, multi-tasking capabilities, check reading and age and identity verification.

12 Claims, 8 Drawing Sheets

THERMAL PRINTER DEVICE FOR POINT OF SERVICE TERMINAL

CROSS-REFERENCE TO RELATED APPLICATION

This application claims priority to and benefit of U.S. Provisional Application No. 60/792,788, entitled "Thermal Printer Device for Point-of-Sale Terminal" and filed on Apr. 17, 2006, which is hereby incorporated by reference in its entirety.

FIELD OF INVENTION

The present invention relates, generally, to printers for point of service ("POS") terminals, and more particularly to a compact printer for POS terminals.

BACKGROUND OF THE INVENTION

Point of service ("POS") terminals enable convenient electronic payment for many products and services. Consumers holding cards associated with a charge, credit, debit, or loyalty account may pay for a purchase simply by using the card with a POS terminal located at stores, restaurants, and other locations where the products and services are being purchased. Upon completion of the transaction, many POS terminals or a peripheral device will print a receipt for the transaction. A common type of printer used in conjunction with a POS terminal is a thermal printer that utilizes a paper roll such as the printer available with the Hypercom T7 Plus terminal.

However, the size of the paper roll in such a thermal printer results in a bulky device that is not very portable or easily hand-held. Accordingly, it is desirable to create a compact, portable printer that may be utilized in a portable, handheld POS terminal.

SUMMARY OF THE INVENTION

The present invention facilitates a portable, hand-held POS terminal that supports printing by providing a compact, thermal printer that may be used with the POS terminal. By including a thermal printer that utilizes fan-folded thermal paper, a POS terminal may be produced that is compact, and yet capable of printing receipts in an efficient manner. When the printer is in operation, one sheet at a time is pulled through the printer. Black marks (other colors or markings may be used) on the perforations of the paper are used by printer software to indicate the top of form (for receipts) and to indicate when the printer is out of paper.

Utilizing a fan-folded paper pack, instead of a bulky paper roll, allows for a more compact POS terminal design that is easy to use and highly portable.

Other features of various embodiments of the present invention may include or support electronic signature capture, an interactive screen, multi-tasking capabilities, age and identity verification, program or account enrollment, account status and balance inquiries, payroll and government check reading, and medical or other insurance claim transactions. The present invention may be used with various types of accounts including credit, debit, charge, and loyalty programs and may also accommodate payment by promotion or gift cards, prepaid cards, payroll checks and government checks.

BRIEF DESCRIPTION OF THE DRAWINGS

Additional aspects of the present invention will become evident upon reviewing the non-limiting embodiments described in the specification and the claims taken in conjunction with the accompanying figures, wherein like reference numerals denote like elements.

DETAILED DESCRIPTION

Figure 1:
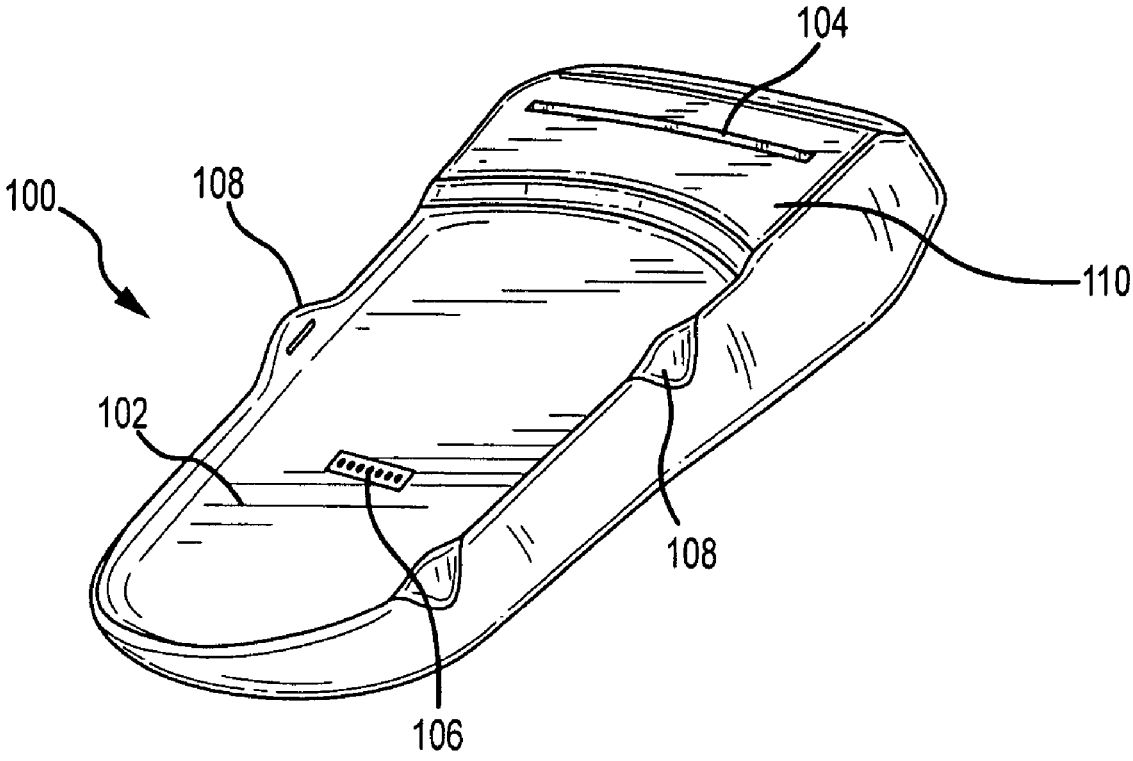
FIG. 1 is a perspective view of an exemplary thermal printer device according to one embodiment of the present invention.
Figure 2:
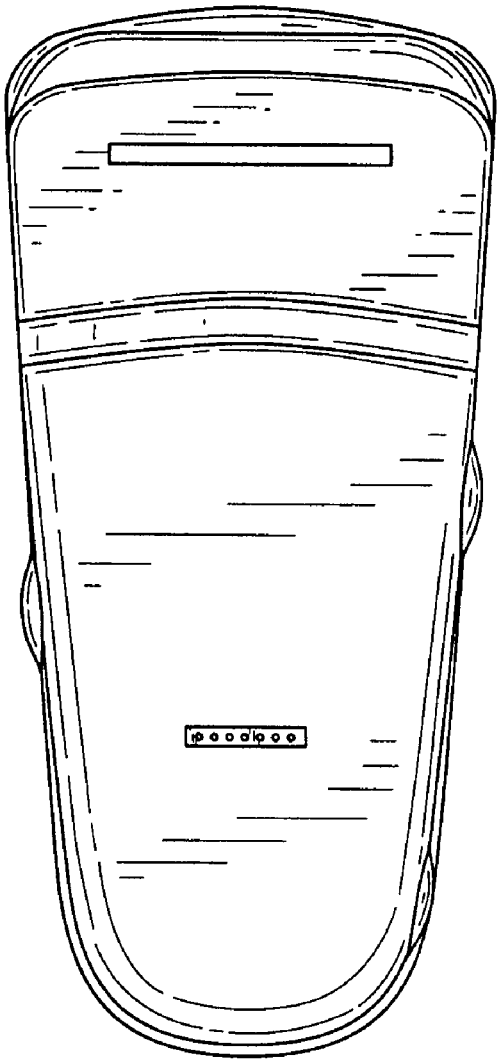
FIG. 2 is a top view of the exemplary thermal printer device of FIG. 1.
Figure 3:
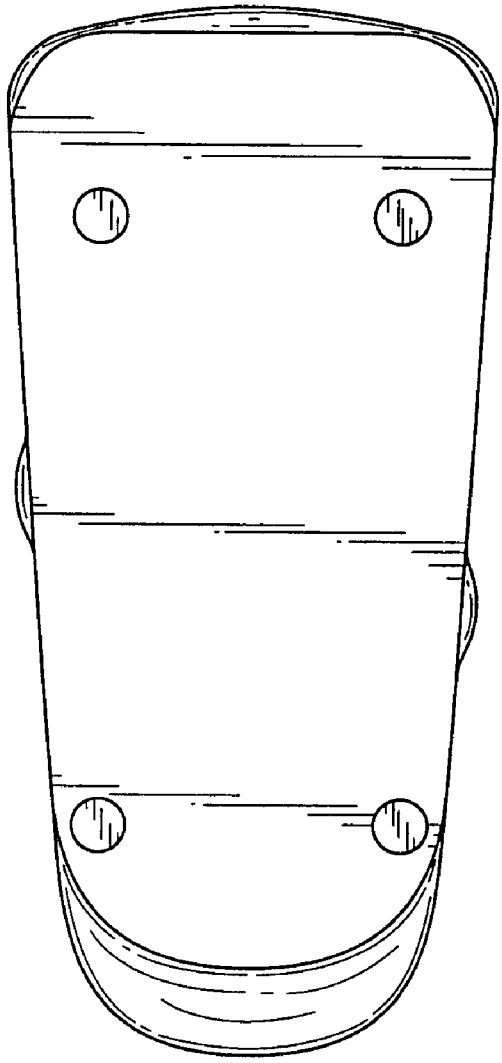
FIG. 3 is a bottom view of the exemplary thermal printer device of FIG. 1.
Figure 4:
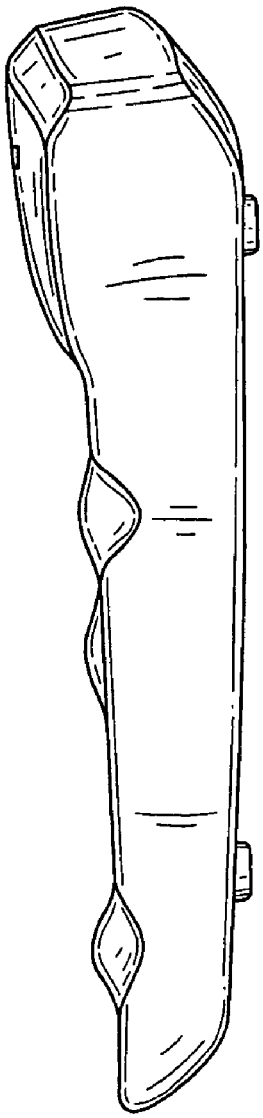
FIGS. 4 and 5 are side views of the exemplary thermal printer device of FIG. 1.
Figure 5:
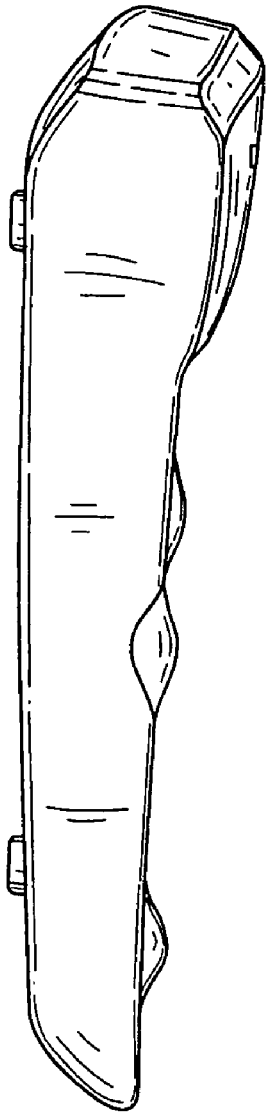
Figure 6:
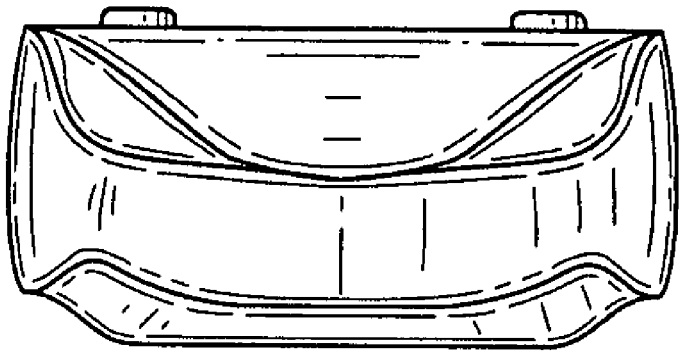
FIG. 6 is a front view of the exemplary thermal printer device of FIG. 1.
Figure 7:
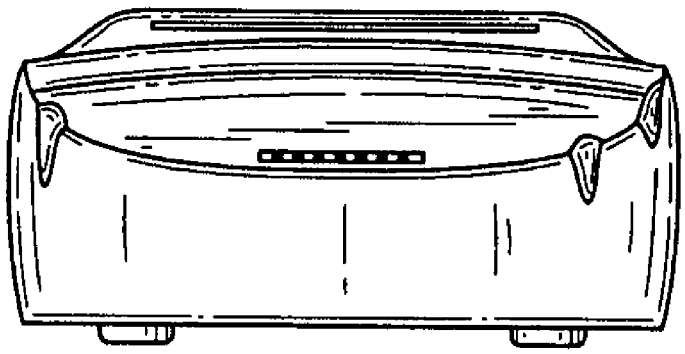
FIG. 7 is a rear view of the exemplary thermal printer device of FIG. 1.
Figure 8:
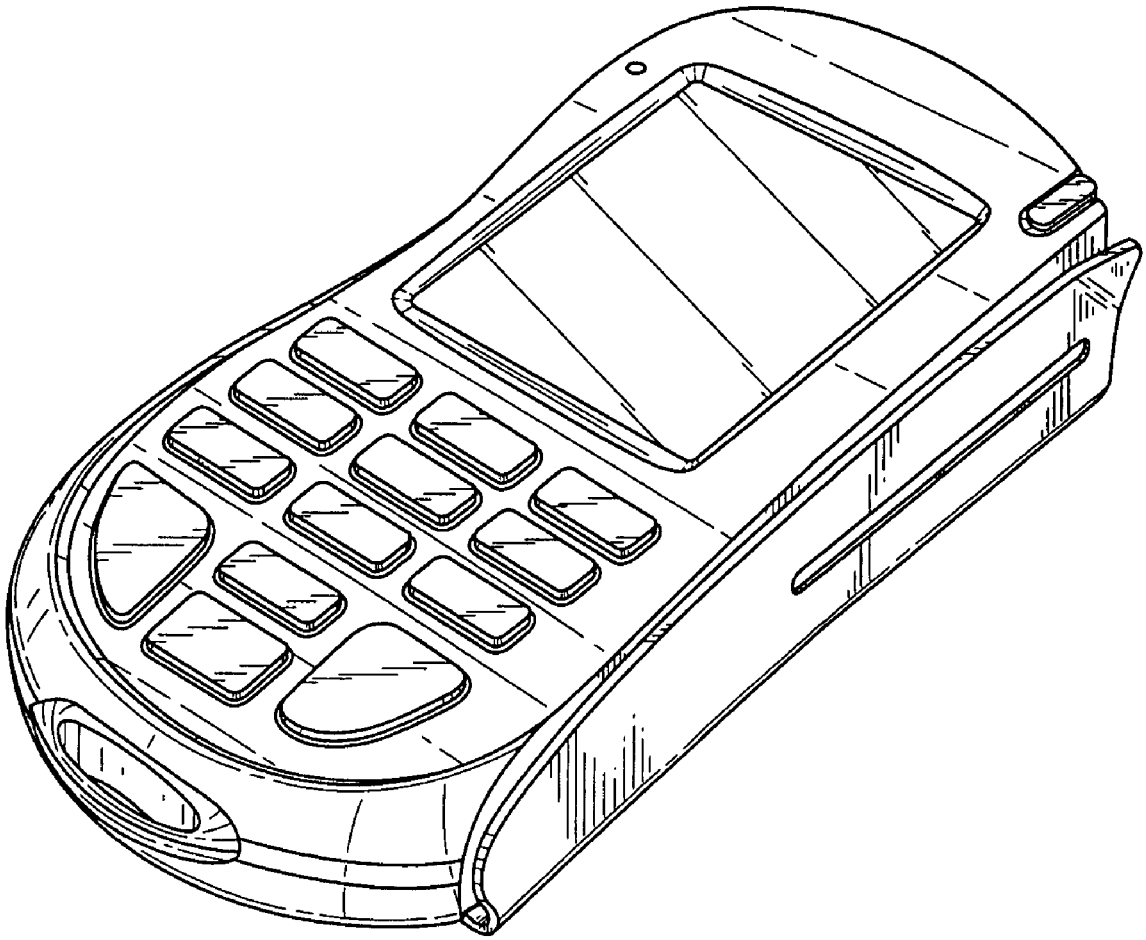
FIG. 8 is a perspective view of an exemplary POS terminal that may be used with the exemplary thermal printer device of FIG. 1.

The detailed description of exemplary embodiments of the invention herein makes reference to the accompanying drawings, which show exemplary embodiments by way of illustration and the best mode. While these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for purposes of illustration only and not of limitation. For example, the steps recited in any of the method or process descriptions may be executed in any order and are not limited to the order presented.

For the sake of brevity, conventional data networking, application development and other functional aspects of the system (and components of the individual operating components of the system) may not be described in detail herein. It should be noted that many alternative or additional functional relationships or physical connections may be present in a practical system.

A point of sale ("POS") terminal according to various embodiments of the present invention includes a card reader, a printer, various electronic circuits for processing a financial transaction, a display for presenting and optionally receiving input of transaction information, a keypad including numeric and function keys, and a housing containing the circuits, display and keypad. The printer may be housed within the POS terminal or the printer may be housed external to the POS terminal. The POS terminal may also be used with a contactless card reader, bar card reader, biometric reader, or other input devices, and thus may provide for a variety of interfaces. Wireless capabilities may also be incorporated into the present invention to promote portability. Other periphery devices for use with the POS terminal may include additional displays, PIN entry pads, alphanumeric keyboards, voice prompt systems, and signature capture devices. The POS terminal may be a stand alone unit or may be integrated into an electronic cash register ("ECR"), vending machine or a self check-out kiosk and the like.

In an exemplary POS transaction, the POS terminal facilitates payments by extracting account information from a user's transaction instrument (e.g., when a user swipes a credit card or inserts a smart card), receiving authentication input, constructing an authorization message, and communicating the authorization message to a host computer to authorize a financial transaction. As used herein, the term "user" includes a consumer, cardholder, merchant, and merchant temporarily in possession of a consumer's transaction card. Cardholder authentication may be accomplished using a PIN number, signature, voice command, biometric input, encrypted transaction instrument data, or any other suitable input. The host computer performs normal authorization procedures and returns one of an authorization and a rejection message. In performing an "on-line" transaction, after the transaction is consummated, the POS terminal communicates the relevant details of the transaction to be stored on the host computer system. While in performing an "off-Line" transaction, the terminal may approve or decline based on tables or card date or other data, and later forward transaction data to the payment manager host computer. At the end of a transaction, the terminal may print a receipt utilizing the printer that is either housed internally within the POS terminal or housed external to the POS terminal. The POS terminal further communicates with the payment manager host computer to reconcile accounts at the end of a predetermined business cycle (e.g., at the end of each day). Communications between the POS terminal and a host computer may be conducted over any suitable network now known or later developed. As used herein, the term "network" shall include any electronic communications means which incorporates both hardware and software components of such. Exemplary networks or communication channels include a telephone network, an extranet, an intranet, Internet, online communications, satellite communications, off-line communications, wireless communications, transponder communications, local area network (LAN), wide area network (WAN), networked or linked devices, and/or any suitable communication or data input modality.

Referring now to FIG. 1, an exemplary embodiment of a thermal printer device 100 in accordance with the present invention is illustrated including a printer 110 having a housing 102, a paper slot 104, and contacts 106 that may be used for charging a POS terminal that is brought into connection with contacts 106. Housing 102 houses various components of printer device 100 including basic components not shown here, such as a power supply circuit, a thermal print head, a spring for applying pressure to the thermal print head such that it contacts the thermo-sensitive paper, and a microcontroller or microprocessor. In addition housing 102 houses a pad 150 of fan-folded paper as illustrated in other figures. In accordance with one embodiment of the present invention, pad 150 comprises fan-folded receipt-sized thermal paper with perforations. The thermal paper of pad 150 is fan-folded such that each sheet of paper is folded to lay flat on top of the sheet of paper that is immediately next to it in the pack. As each sheet of paper in the pack is folded so that the sheet lies immediately below the next sheet in the pack, the width and length dimensions of the fan-folded pack is determined by the width and length dimensions of a sheet of the paper. By experimentation, it has been found in one embodiment of the present invention, that this can result in a pad of fan-folded paper with dimensions of approximately 70 mm long, 55 mm wide, and 10 mm tall. By comparison, a roll of thermal paper would be much taller, likely over three times the height of a pack of fan-folded paper. Thus, it should be appreciated that this will result in a printer that this is much more compact than a printer that uses a paper roll, and therefore this will facilitate printing in a more portable POS terminal. By experimentation, it has been found in one embodiment of the present invention, that a printer that utilizes a fan-folded paper pack may comprises a printer that is approximately ¾ inch thick and 5 inches long.

Figure 9:
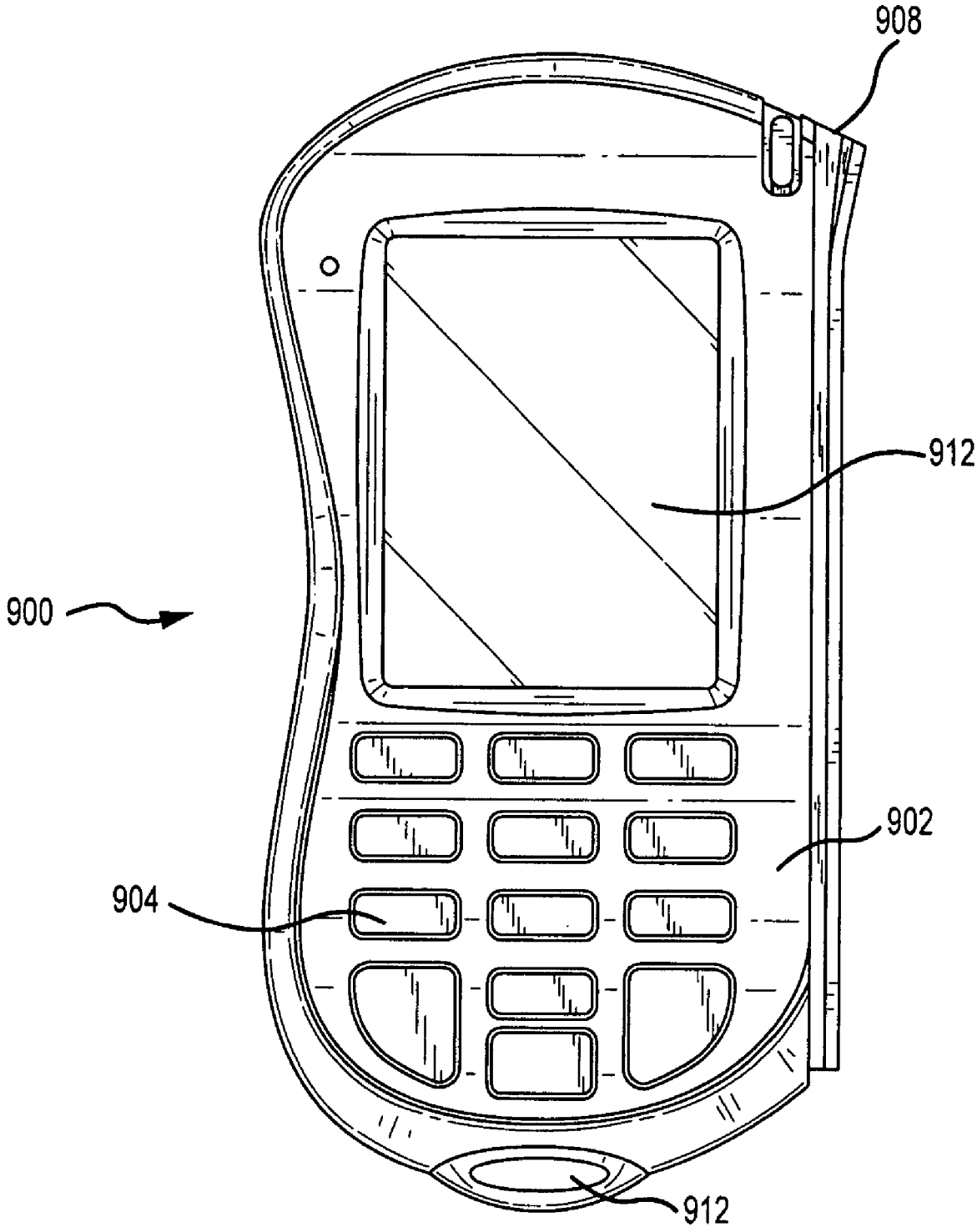
FIG. 9 is a top view of the exemplary POS terminal of FIG. 8.
Figure 10:
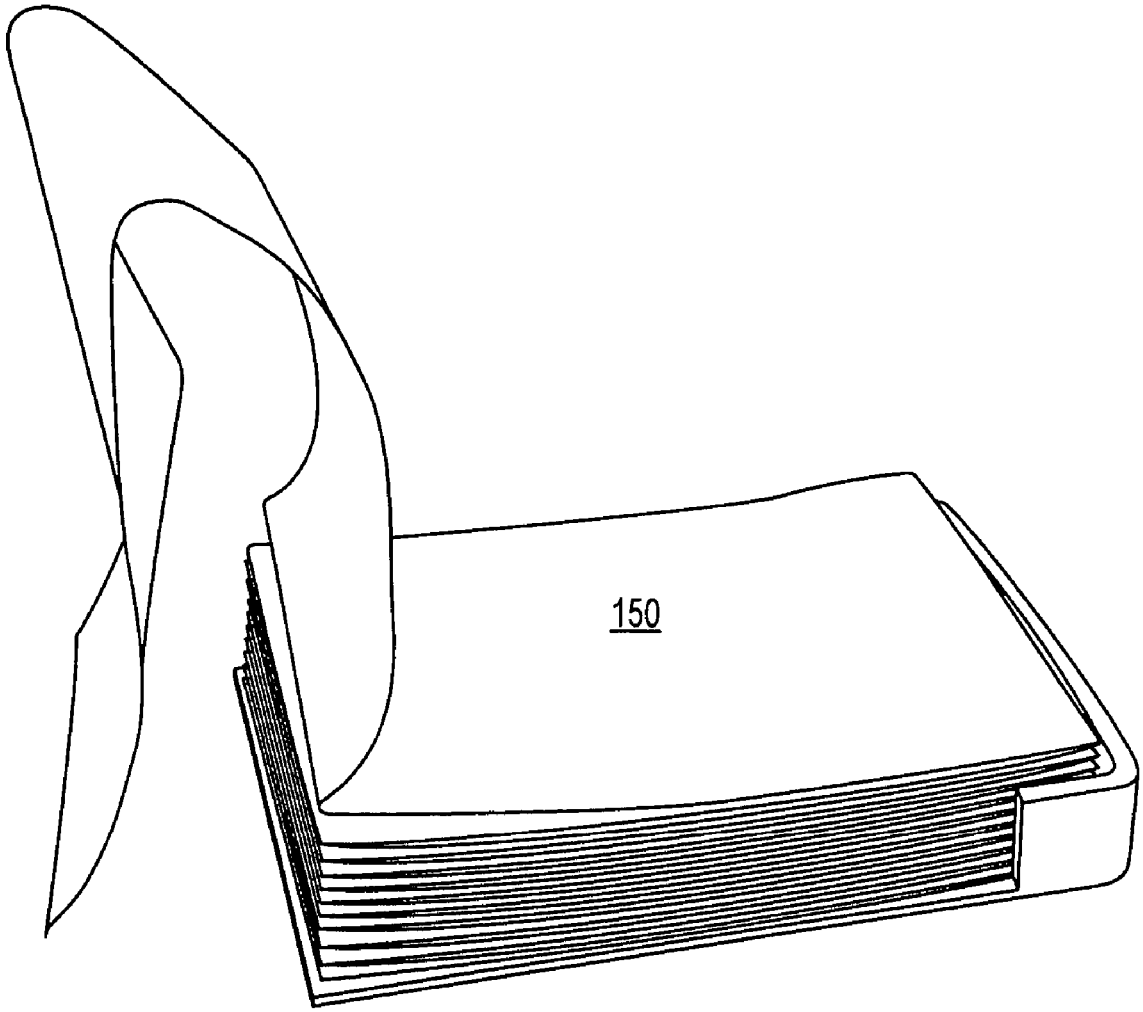
FIG. 10 illustrates a fan-folded pack of thermal printer paper in accordance with an exemplary embodiment of the present invention.

Referring now to FIG. 9, an exemplary embodiment of a POS terminal in accordance with the present invention is illustrated including a POS terminal 900 having a housing 902, a key pad 904, an interactive display 906, and a magnetic card track 908. Housing 902 houses various components of POS terminal 900 including basic components not shown here, such as a power supply circuit, internal clock, microcontroller or microprocessor, ROM, RAM, lights, and other suitable hardware for communicating with a host computer, and inputting, processing, transferring or displaying transaction data.

Housing 902 includes magnetic card track 908 formed therein. Other embodiments of the present invention may utilize smart card readers and/or contactless card readers. Track 908 includes two sidewalls for guiding a user's transaction card to facilitate extraction of card data from a magnetic stripe on the card.

Figure 11A:
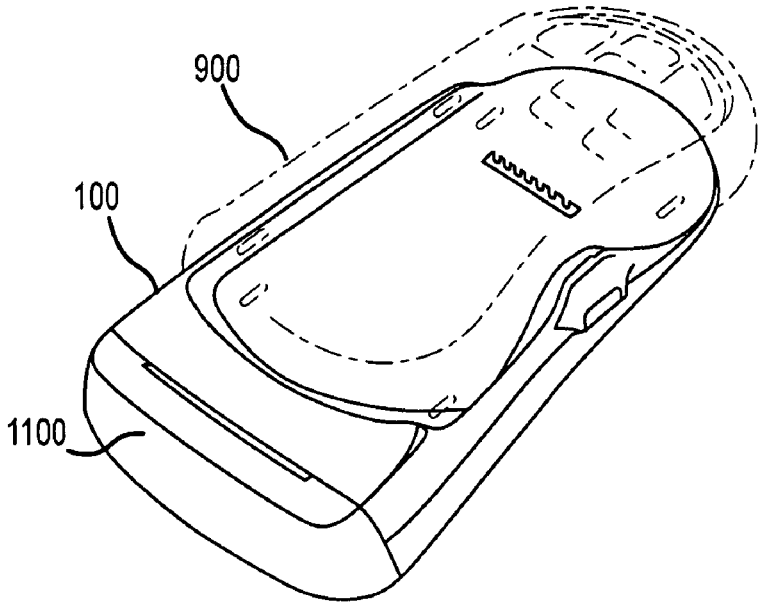
FIGS. 11A and B illustrated an exemplary POS terminal docked on an exemplary thermal printer device in accordance with an embodiment of the present invention.
Figure 11B:
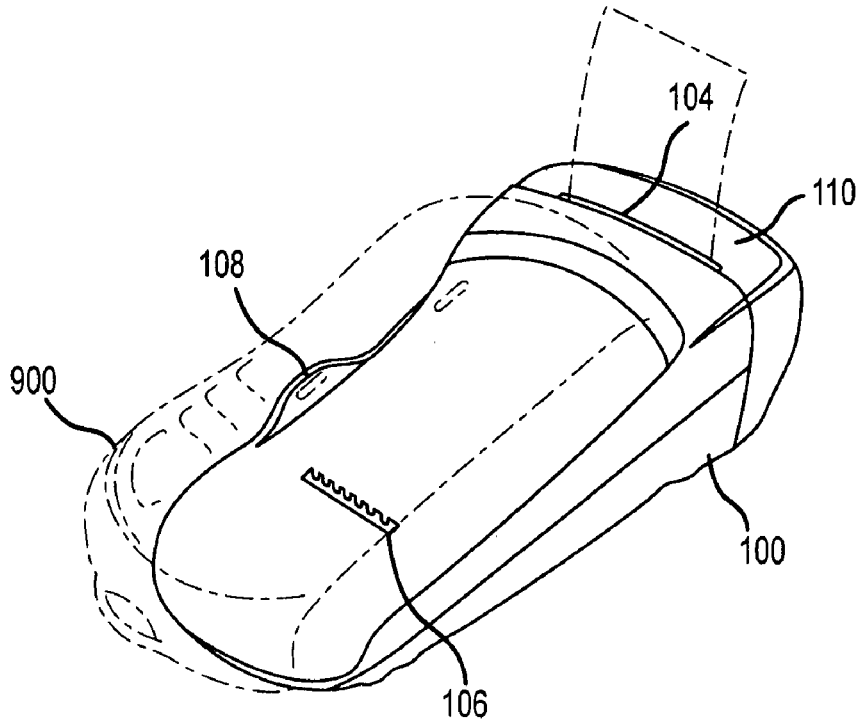

In accordance with one embodiment of the present invention, POS terminal 900 may be positioned on top of printer device 100 as illustrated in FIGS. 11A and 11B. Release tabs 108 are used to hold POS terminal 900 in place. In accordance with one aspect of this embodiment, contacts 106 may be used to provide an electrical charge to POS terminal 900 such that the terminal's batteries may be charged. The paper exits printer 110 from slot 104 located in the rear of the printer. In addition, printer device 100 includes a rear door 1100 that pivots downward such that the thermal paper and printer mechanism may be accessed.

In operation, POS terminal 900 may transmit transaction information to printer 110 such that printer 110 can print a receipt for the transaction. POS terminal 900 may transmit the transaction information to printer device 100 in a variety of ways, including via IP, Ethernet, and/or USB port, or via wireless connection. Printer 110 prints the transaction information onto paper from fan-folded paper pack 150 utilizing thermal printing technology. After the information is printed onto the paper, the paper exits printer 110 via printer slot 104.

When the printer is in operation, one sheet at a time is pulled through the printer. Black marks (other colors or markings may be used) on the perforations of the paper may be used by printer software to indicate the top of form (for receipts) and to indicate when the printer is out of paper. When the printer is completed printing the receipt for a transaction, the printer may advance the paper to the next perforation by using the black marks to determine the beginning of the next sheet. A sensor in the printer may be used to detect the black marks or other similar marking, such that the paper may be advanced to the next perforation. In accordance with one embodiment of the present invention, the sensor may be located proximate to the printer head. In accordance with an alternative embodiment of the present invention, no marks may be present on the paper. The sensor may also be configured to detect when the printer is out of paper.

Housing 902 may include a lanyard opening 912 for connecting a lanyard or similar cord to housing 902. In this manner, a user may carry the POS terminal on their belt, backpack, and the like. In accordance with one embodiment of the present invention, housings 102 and 902 may comprise a zinc alloy chassis, resulting in a highly portable, compact POS terminal and printer. In addition, modular or peripheral devices may connect to housing 102, either via a socket or through a wireless connection (not illustrated). Exemplary modular peripheral devices include contactless transaction instrument readers, radio frequency readers, infrared and wireless communications devices, supplemental magnetic stripe readers, PIN keypads, bar code scanners, printers, modems, telephone handsets, biometric scanners, voice command input devices and the like. Similarly, any peripheral device or capability now known or later developed may be integrated into or associated with POS terminal 900. Additionally, housing 902 may include features such as a latch, clip, or slot to facilitate docking, tabletop, pedestal or stand mounting.

Keypad 904 comprises an alphanumeric keypad including keys numbered zero through nine for entry of PIN numbers. Keypad 904 may also include any number of function keys, such as, for example, keys for canceling a transaction, specifying the type of transaction instrument, selecting whether to print a receipt, confirming a charge amount, or for any other relevant feature. Alphanumeric and/or function keys on keypad 904 may be separately movable as with a conventional keyboard, or may be displayed on an interactive surface that responds to pressure, static, or any other suitable user input or action. In accordance with one embodiment of the present invention, keypad 904 is integrated into interactive display 906 as a series of on-screen interactive icons. Exemplary function keys or icons include: cancel, enter, clear, print, reset, power, debit, credit, cash back, additional transaction selection, preset dollar amounts for cash back, and the like.

With continued reference to the embodiment shown in FIG. 9, interactive display 906 serves to display transaction information and with an optional touch screen, may also receive user input such as a customer's signature. Various embodiments include electronic signature capture, enabling user's to electronically authorize a transaction by passing a stylus or pen over the display much the same as signing a conventional paper receipt. Replaceable screen protectors protect display 906 from wear by the stylus. Display 906 may present advertising or interactive messages such flashing or moving messages notifying users of merchant membership programs, sales, upcoming events and the like. In alternative embodiments, display 906 is not interactive but merely displays transaction data while providing no signature capture, interactive icons or other on-screen user input capabilities. In additional alternative embodiments, POS terminal 900 does not include any type of display 906, for example, when POS terminal 900 is coupled to a cash register including a display. Alternatively, a stand alone POS terminal 900 need not have any form of display 906 to facilitate a transaction.

In one embodiment of the invention, a transceiver disposed in POS terminal 900 and associated programming modules support wireless communication between POS terminal 900 and a host computer. This wireless communication enables the POS terminal to be portable and even held in a user's hand. The user can carry the POS terminal with them as they carry out their business.

One embodiment of the invention supports age and identity verification by extracting user data from a user's transaction instrument, requesting authentication input, and verifying the user data and authentication input with user data stored on the host system of the transaction instrument issuer. Age and identity verification may likewise be performed using any appropriate transaction instrument data, host system data or user supplied data.

One embodiment of the invention supports payroll check and government check reading and/or cashing. For example, the POS terminal facilitates the capture of routing and account numbers, and any other relevant information from bar codes or other machine readable indicia printed or otherwise accessible on such checks. Thus, a consumer may present such checks for immediate electronic verification and drawing of funds from the check issuer's account for use in payment at a POS terminal. In embodiments that include a cash return device, a consumer may receive any remaining balance of the check value as cash.

In one embodiment of the invention, IP and/or USB ports enable connectivity of the POS terminal with a docking station, printer device, keyboard, personal computer, or with additional POS terminals. Additionally, the POS terminal may support both Ethernet and modem connectivity capabilities. Redundant communications connectivity capabilities serve to reduce or eliminate the impact of temporary network failures by automatically reestablishing communications with a host system using a backup communications channel. For example, if a local internet network hub fails, the POS automatically dials the appropriate host system using a backup modem. Additional wireless communication capabilities enable portable use of the POS terminal. For example, a salesperson may carry a wireless POS terminal on his or her belt for assisting customer's with showroom purchases without the need to relocate to a cashier's desk Benefits, other advantages, and solutions to problems have been described herein with regard to specific embodiments. However, the benefits, advantages, solutions to problems, and any element(s) that may cause any benefit, advantage, or solution to occur or become more pronounced are not to be construed as critical, required, or essential features or elements of any or all the claims or the invention. The scope of the present invention is accordingly to be limited by nothing other than the appended claims, in which reference to an element in the singular is not intended to mean "one and only one" unless explicitly so stated, but rather "one or more." Further, no element described herein is required for the practice of the invention unless expressly described as "essential" or "critical."

What is claimed is:

1. A thermal printer device comprising:

a housing; and a thermal printer disposed in the housing, wherein the thermal printer comprises:

a fan-folded thermal printer;

a thermal print head;

a pack of fan folded thermal paper;

a sensor;

a paper slot; and a release tab, wherein the release tab is configured to hold a point of service terminal in a docking position on the thermal printer device.

2. The thermal printer device of claim 1, further comprising a plurality of electrical contacts for charging the point of service terminal.

3. The thermal printer device of claim 1, further comprising a door, wherein the door is configured to pivotally open.

4. The thermal printer device of claim 1, wherein the fan folded thermal paper is approximately receipt sized.

5. The thermal printer device of claim 1, wherein the pack of fan folded paper is approximately 70 mm long, 55 mm wide, and 10 mm tall.

6. The thermal printer device of claim 1, wherein the sensor is configured to detect a mark on the thermal paper, wherein the mark is positioned at a perforation on the thermal paper.

7. A point of service transaction system comprising:

a point of service terminal;

a thermal printer device, wherein the point of service terminal is releasably docked on the thermal printer device, and wherein the thermal printer device comprises:

a housing; and a thermal printer disposed in the housing, wherein the thermal printer comprises:

a fan-folded thermal printer;

a thermal print head;

a pack of fan folded thermal paper;

a sensor; and a paper slot.

8. The point of service transaction system of claim 7, wherein the thermal printer device further comprises a plurality of electrical contacts for charging the point of service terminal.

9. The point of service transaction system of claim 7, wherein the thermal printer device further comprises a door, wherein the door is configured to pivotally open and provide access to the thermal printer.

10. The point of service transaction system of claim 7, wherein the fan folded thermal paper is approximately receipt sized.

11. The point of service transaction system of claim 7, wherein the pack of fan folded paper is approximately 70 mm long, 55 mm wide, and 10 mm tall.

12. The point of service transaction system of claim 7, wherein the sensor is configured to detect a mark on the thermal paper, wherein the mark is positioned at a perforation on the thermal paper.

* * * * *